US007019450B2

(12) United States Patent
Gaertner et al.

(10) Patent No.: US 7,019,450 B2
(45) Date of Patent: Mar. 28, 2006

(54) CATHODE RAY TUBE WITH A PARTICLE-PARTICLE CATHODE COATING

(75) Inventors: Georg Friedrich Gaertner, Aachen (DE); David Steven Barratt, Rossendale (GB); Christopher James Goodhand, Blackburn (GB); Detlef Raasch, Aachen (DE); Petrus Arthur Marie Van Der Heide, Clitheroe (GB); Timothy John Lee, Settle (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 68 days.

(21) Appl. No.: 10/130,338

(22) PCT Filed: Sep. 11, 2001

(86) PCT No.: PCT/EP01/10453

§ 371 (c)(1),
(2), (4) Date: May 16, 2002

(87) PCT Pub. No.: WO02/25681

PCT Pub. Date: Mar. 28, 2002

(65) Prior Publication Data

US 2002/0163308 A1 Nov. 7, 2002

(30) Foreign Application Priority Data

Sep. 19, 2000 (EP) ..... 00308164
May 2, 2001 (EP) ..... 01201836

(51) Int. Cl.
*H01J 1/14* (2006.01)

(52) U.S. Cl. ..... 313/346 R; 313/346 DC

(58) Field of Classification Search ..... 313/346 R, 313/346 DC, 355, 337, 270
See application file for complete search history.

(56) References Cited

U.S. PATENT DOCUMENTS

| | | | | |
|---|---|---|---|---|
| 4,797,593 | A | 1/1989 | Saito et al. | 313/346 R |
| 4,924,137 | A * | 5/1990 | Watanabe et al. | 313/337 |
| 5,118,984 | A * | 6/1992 | Saito et al. | 313/346 R |
| 5,592,043 | A * | 1/1997 | Gartner et al. | 313/346 DC |
| 6,124,666 | A * | 9/2000 | Saito et al. | 313/346 R |
| 6,348,756 | B1 * | 2/2002 | Gartner et al. | 313/346 R |
| 6,545,397 | B1 * | 4/2003 | Ohira et al. | 313/346 R |

FOREIGN PATENT DOCUMENTS

JP 11204019 A 11/1999

* cited by examiner

*Primary Examiner*—Mariceli Santiago
*Assistant Examiner*—Anthony Perry

(57) ABSTRACT

The invention relates to a cathode ray tube equipped with at least one oxide cathode comprising a cathode carrier having a cathode base of a first cathode metal and having a covering layer of ultrafine metal particles that contain nickel. The oxide cathode also comprises a cathode coating of an electron-emitting material containing a particle-particle composite of oxide particles and metal particles. The oxide particles comprise an oxide selected among the oxides of scandium, yttrium and the lanthanoids cerium, praseodymium, neodymium, samarium, europium, gadolinium, terbium, dysprosium, holmium, erbium, thulium, ytterbium and lutetium, and an alkaline earth oxide selected among the group consisting of the oxides of calcium, strontium and barium, and the metal particles contain a second cathode material selected from the group consisting of Ni, Co, Ir, Pd, Rh and Pt. The invention also relates to an oxide cathode.

18 Claims, 1 Drawing Sheet

CATHODE RAY TUBE WITH A PARTICLE-PARTICLE CATHODE COATING

BACKGROUND AND SUMMARY

The invention relates to a cathode ray tube fitted with at least one cathode comprising a cathode carrier with a cathode base of a first cathode metal and a cathode coating of an electron-emitting material containing a second cathode metal and at least one alkaline earth oxide selected among the group consisting of the oxides of calcium, strontium and barium.

A cathode ray tube is composed of four functional groups:

electron beam generation in the electron gun, beam focusing using electrical or magnetic lenses, beam deflection to generate a raster, and luminescent screen or display screen.

The functional group relating to electron beam generation comprises an electron-emitting cathode, which generates the electron current in the cathode ray tube and which is enclosed by a control grid, for example a Wehnelt cylinder having an apertured diaphragm on the front side.

An electron-emitting cathode for a cathode ray tube generally is a punctiform, heatable oxide cathode with an electron-emitting, oxide-containing cathode coating. If an oxide cathode is heated, then electrons are evaporated from the electron-emitting coating into the surrounding vacuum.

The quantity of electrons that can be emitted from the cathode coating depends on the work function of the electron-emitting material. Nickel, which is customarily used for the cathode base, has itself a comparatively high work function. For this reason, the metal of the cathode base is customarily coated with another material, which mainly serves to improve the electron-emitting properties of the cathode base. A characteristic feature of the electron-emitting coating materials of oxide cathodes is that they comprise an alkaline earth metal in the form of the alkaline earth metal oxide.

To manufacture an oxide cathode, a suitably shaped sheet of a nickel alloy is coated, for example, with the carbonates of the alkaline earth metals in a binder preparation. During evacuating and baking out the cathode ray tube, the carbonates are converted to the oxides at temperatures of approximately 1000° C. After this burn-off of the cathode, said cathode already supplies a noticeable emission current which, however, is still unstable. Next, an activation process is carried out. This activation process causes the originally nonconducting ionic lattice of the alkaline earth oxides to be converted to an electronic semiconductor in that donor-type impurities are incorporated in the crystal lattice of the oxides. These impurities essentially consist of elementary alkaline earth metal, for example calcium, strontium or barium. The electron emission of the oxide cathodes is based on the impurity mechanism. Said activation process serves to provide a sufficiently large quantity of excess, elementary alkaline earth metal, which enables the oxides in the electron-emitting coating to supply the maximum emission current at a prescribed heating capacity. A substantial contribution to the activation process is made by the reduction of barium oxide to elementary barium by alloy constituents ("activators") of the nickel from the cathode base.

For the function and the service life of an oxide cathode it is important that elementary alkaline earth metal is continuously dispensed. The reason for this being that the cathode coating continuously loses alkaline earth metal during the service life of the cathode. The cathode material partly evaporates slowly and is partly sputtered off by the ion current in the cathode ray tube.

However, initially the elementary alkaline earth metal is continuously dispensed. Said dispensation of elementary alkaline earth metal by reduction of the alkaline earth oxide at the cathode metal or activator metal stops, however, when a thin, yet high-impedance interface of alkaline earth silicate or alkaline earth aluminate forms between the cathode base and the emitting oxide in the course of time. The service life is also influenced by the fact that the amount of activator metal in the nickel alloy of the cathode base becomes depleted in the course of time.

JP 11204019 A discloses an oxide cathode with improved donor density and a longer service life, which comprises a cup of a nickel alloy, which is filled with a clew of a nickel alloy and with an alkaline earth carbonate mixture.

It is an object of the invention to provide a cathode ray tube, the beam current of which is uniform and remains constant for a long period of time, while said cathode ray tube can be reproducibly manufactured.

In accordance with the invention, this object is achieved by a cathode ray tube fitted with at least one oxide cathode, which comprises a cathode carrier having a cathode base of a first cathode metal with a covering layer composed of ultrafine metal particles that contain nickel, and which further comprises a cathode coating of an electron-emitting material containing a particle-particle composite material of oxide particles and metal particles, which oxide particles comprise an oxide selected among the oxides of scandium, yttrium and the lanthanoids cerium, praseodymium, neodymium, samarium, europium, gadolinium, terbium, dysprosium, holmium, erbium, thulium, ytterbium and lutetium, and an alkaline earth oxide selected among the group consisting of the oxides of calcium, strontium and barium, and the metal particles contain a second cathode metal selected from the group consisting of Ni, Co, Ir, Pd, Rh and Pt.

A cathode ray tube comprising such an oxide cathode has a constant beam current for a long period of time, which can be attributed to the fact that the homogeneous distribution of the reductive cathode metal and the activator metal in the material of the electron-emitting cathode coating causes the growth of high-impedance intermediate layers to be locally distributed and reduced. Elemental barium can be dispensed for a longer period of time. The effect of the coating layer composed of ultrafine metal particles containing nickel is very advantageous. Said coating layer forms a disintegrated boundary between the cathode base and the cathode coating. As a result the formation of a high-impedance deactivated interlayer between the cathode base and the cathode coating becomes discontinuous and the resistance of the high-impedance interlayer is reduced. Local activator dispensation and activator diffusion are enhanced.

As barium is dispensed continuously, depletion of the electron emission, as known from the oxide cathodes according to the prior art, is precluded. Substantially higher beam current densities can be obtained without adversely affecting the service life of the cathode. This can also be used to draw the necessary electron beam currents from smaller cathode regions. The spot size of the cathode spot determines the beam focusing quality on the display screen. The picture definition is increased throughout the screen. As, in addition, aging of the cathodes is a very slow process, picture brightness and picture definition can be maintained at a high level throughout the service life of the tube.

For the first cathode metal use is preferably made of a metal selected among the group consisting of Ni, Co, Ir, Re, Pd, Rh and Pt.

It is particularly preferred that the first cathode metal contains an alloy of a metal selected among the group consisting of Ni, Co, Ir, Re, Pd, Rh, Pt and an activator metal selected among the group consisting of Mg, Mn, Fe, Si, W, Mo, Cr, Ti, Hf, Zr, Al.

In accordance with a preferred embodiment, the covering layer additionally comprises an activator metal selected among the group consisting of Mg, Mn, Fe, Si, W, Mo, Cr, Ti, Hf, Zr, Al. By virtue thereof, the sensitivity to "poisioning" by residual gases in the crt-vacuum is reduced.

It is particularly preferred that the metal particles comprise a slow activator selected among the group consisting of Al, Mo, Ti and Si. The slow activators are preferably added in a quantity ranging from 1 to 4% by weight.

It may alternatively be preferred that the metal particles in the electron-emitting material comprise an alloy of a second cathode metal selected among the group consisting of Ni, Co, Ir, Re, Pd, Rh, Pt and an activator metal selected among the group consisting of Mg, Mn, Fe, Si, W, Mo, Cr, Ti, Hf, Zr, Al.

The oxide particles may comprise oxide particles of an alkaline earth oxide selected among the group of oxides consisting of calcium, strontium and barium, which is doped with an oxide selected among the oxides of scandium, yttrium and the lanthanoids cerium, praseodymium, neodymium, samarium, europium, gadolinium, terbium, dysprosium, holmium, erbium, thulium, ytterbium and lutetium.

In accordance with a particularly preferred embodiment, the oxide particles comprise oxide particles of an alkaline earth oxide selected among the group of oxides consisting of calcium, strontium and barium, which is doped with one of the oxides of yttrium. It has surprisingly been found that yttrium oxide accelerates the sintering of the oxides in the manufacturing process.

In accordance with a further embodiment of the invention, the oxide particles comprise oxide particles of an oxide selected among the oxides of scandium, yttrium and the lanthanoids cerium, praseodymium, neodymium, samarium, europium, gadolinium, terbium, dysprosium, holmium, erbium, thulium, ytterbium and lutetium, and oxide particles of an alkaline earth oxide selected among the group of oxides consisting of calcium, strontium and barium.

The electron-emitting material may contain metal particles in a quantity ranging from 1 to 5% by weight.

It is particularly preferred that the electron-emitting material contains nickel particles in a quantity of 2.5% by weight.

Particularly advantageous effects of the invention in relation to the prior art are achieved if the metal particles are shaped so as to be ellipsoidal or spherical. By virtue thereof, diffusion of the activator metals takes place in a more controlled manner and a more uniform barium emission, as regards time and place, is achieved. Oxide cathodes having a higher direct current carrying capacity and longer service life are obtained.

If the metal particles are needle-shaped, this may help to keep the diffusion of the activator metals constant throughout the service life of the oxide cathode.

The average particle diameter of the metal particles preferably ranges from 0.2 to 5.0 μm.

It may also be preferred that the metal particles are embedded in the particle-particle composite so as to be oriented, particularly that the metal particles are embedded in the particle-particle composite so as to extend vertically to the surface of the cathode base.

Alternatively, the metal particles are embedded in the particle-particle composite with a concentration gradient.

The invention also relates to an oxide cathode, which comprises a cathode carrier having a cathode base of a first cathode metal with a covering layer composed of ultrafine metal particles that contain nickel, and having a cathode coating of an electron-emitting material containing a particle-particle composite material of oxide particles and metal particles, which oxide particles comprise an oxide selected among the oxides of scandium, yttrium and the lanthanoids cerium, praseodymium, neodymium, samarium, europium, gadolinium, terbium, dysprosium, holmium, erbium, thulium, ytterbium and lutetium, and an alkaline earth oxide selected among the group consisting of the oxides of calcium, strontium and barium, and the metal particles contain a second cathode metal selected from the group consisting of Ni, Co, Ir, Pd, Rh and Pt.

These and other aspects of the invention will be apparent from and elucidated with reference to one embodiment described hereinafter.

DETAILED DESCRIPTION

Figure 1:
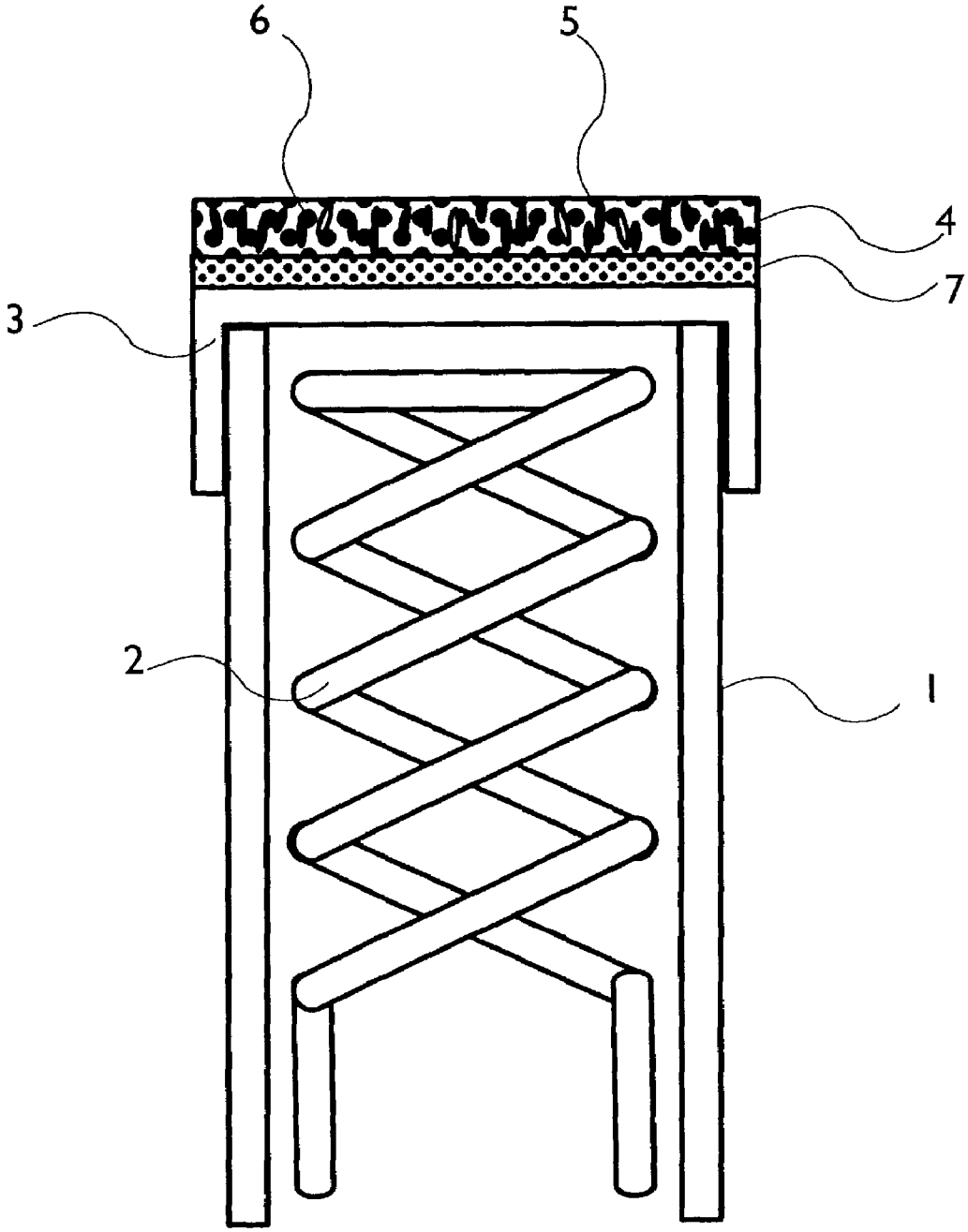
FIG. 1 is a diagrammatic cross-sectional view of an embodiment of the oxide cathode in accordance with the invention.

A cathode ray tube is equipped with an electron beam-generating system which customarily includes an arrangement with one or more oxide cathodes.

An oxide cathode in accordance with the invention comprises a cathode carrier with a cathode base and a covering layer, which is composed of nickel-containing ultrafine metal particles, and a cathode coating. The cathode carrier includes the heater and the base with the covering layer. For the cathode carrier use can be made of the constructions and materials known from the prior art.

In the embodiment of the invention shown in FIG. 1, the oxide cathode comprises a cathode carrier, i.e. a cylindrical tube 1 wherein the heating wire 2 is inserted, a top cap 3 forming the cathode base, with the covering layer 7, and a cathode coating 4 which constitutes the actual cathode body.

For the material of the cathode base use is preferably made of a metal selected among the group consisting of Ni, Co, Ir, Re, Pd, Rh, and Pt. Customarily, the material used for the cathode base is a nickel alloy. The nickel alloys used for the base of the oxide cathodes in accordance with the invention may comprise nickel with an alloying constituent of an activator element having a reducing effect selected from the group formed by magnesium, manganese, iron, silicon, tungsten, molybdenum, chromium, titanium, hafnium, zirconium and aluminum. As the cathode coating also comprises activator elements, a small quantity of activator elements in the material for the cathode base is sufficient. A quantity of 0.05 to 0.8% activator metal as the alloying constituent in the material for the cathode base is preferred.

The cathode base is coated with a covering layer composed of ultrafine nickel-containing metal particles. The particle size of the ultrafine particles is below 100 nm. The ultrafine particles preferably comprise an activator selected among the group consisting of Mg, Mn, Al, Mo, Ti, Si, Cr, Zr. It is particularly preferred that the metal particles comprise a slow activator selected among the group consisting of Al, Mo, Ti and Si. The slow activators are preferably added in a quantity ranging from 1 to 4% by weight.

The cathode coating comprises an electron-emitting material composed of a particle-particle composite material. The main components of the particle-particle composite material in the electron-emitting material are oxide particles 6, which contain an oxide selected among the oxides of scandium, yttrium and the lanthanoids cerium, praseodymium, neodymium, samarium, europium, gadolinium, terbium, dysprosium, holmium, erbium, thulium, ytterbium and lutetium, and an alkaline earth oxide selected among the group consisting of the oxides of calcium, strontium and barium.

The oxide particles may comprise oxide particles containing oxides of the alkaline earth metals doped with the oxides of scandium, yttrium and the lanthanoids cerium, praseodymium, neodymium, samarium, europium, gadolinium, terbium, dysprosium, holmium, erbium, thulium, ytterbium and lutetium.

In accordance with a further embodiment of the invention, the oxide particles comprise oxide particles containing oxides of the alkaline earth metals and oxide particles containing the oxides of scandium, yttrium and the lanthanoids cerium, praseodymium, neodymium, samarium, europium, gadolinium, terbium, dysprosium, holmium, erbium, thulium, ytterbium and lutetium.

For the alkaline earth oxide use is preferably made of barium oxide in conjunction with calcium oxide or/and strontium oxide. The alkaline earth oxides are used as a physical mixture of alkaline earth oxides or as binary or ternary mixed crystals of the alkaline earth metal oxides. Preferably, use is made of a ternary alkaline earth mixed crystal oxide of barium oxide, strontium oxide and calcium oxide or a binary mixture of barium oxide and calcium oxide.

The alkaline earth oxide may contain a doping of an oxide selected from the oxides of scandium, yttrium and the lanthanoids cerium, praseodymium, neodymium, samarium, europium, gadolinium, terbium, dysprosium, holmium, erbium, thulium, ytterbium and lutetium, for example in a quantity from 10 to maximally 1000 ppm. The ions of scandium, yttrium and the lanthanoids occupy lattice sites or interstitial lattice sites in the crystal lattice of the alkaline earth metal oxides. Preferably yttrium is used as a dopant. The doped oxides are obtained through co-precipitation.

Alternatively, oxide particles of the alkaline earth oxides and oxide particles of the oxides of scandium, yttrium and the lanthanoids cerium, praseodymium, neodymium, samarium, europium, gadolinium, terbium, dysprosium, holmium, erbium, thulium, ytterbium and lutetium can also be separately manufactured and used as a physical mixture.

As the second component, the particle-particle composite of the electron-emitting material comprises metal particles 5 containing the second cathode metal. The material for the second component is an alloy of a second cathode metal selected among the group consisting of Ni, Co, Ir, Re, Pd, Rh, Pt and an activator metal selected among the group consisting of Mg, Mn, Fe, Si, W, Mo, Cr, Ti, Hf, Zr, Al.

For the particle-particle composite material of the invention, use can preferably be made of metal particles that are shaped so as to be ellipsoidal or spherical. The average grain diameter preferably ranges from 0.2 to 5.0 μm. Alternatively, needle-shaped metal particles having a maximum grain diameter in the range from 10 to 15 μm can be used. By means of a suitable deposition processes, such needle-shaped particles can be vertically oriented to the cathode base.

For particles having a small grain diameter, use can very suitably be made of slowly diffusing activator metals such as Mo and W in a concentration of 2 to 10% by weight in the alloy. Conversely, activator metals having a higher rate of diffusion, such as Zr and Mg, can suitably be used as particles having a larger grain diameter.

For the covering layer on the cathode base, the ultrafine particles containing nickel or another cathode metal can be manufactured from the relevant target by means of a laser ablation process. These targets contain cathode nickel that may be alloyed with activators such as Mg, Al, Ti, Zr, Mn, Si, Cr. It is possible, for example, to separately manufacture the ultafine particles for the covering layer and apply them to the cathode base by means of a customary coating process. It is alternatively possible to deposit the ultrafine particles for the covering layer directly on the cathode base by laser ablation. It is furthermore possible to employ wet-chemical or sol-gel preparation methods to produce the ultrafine particles.

To manufacture the raw material for the cathode coating, the carbonates of the alkaline earth metals calcium, strontium and barium are ground and mixed. The weight ratio of calcium carbonate : strontium carbonate: barium carbonate : zirconium is typically 25.2:31.5:40.3:3 or 1:1.25:6 or 1:12 22 or 1:1.5:2.5 or 1:4:6. To the carbonates are added one or more oxides of scandium, yttrium, and the lanthanoids cerium, praseodymium, neodymium, samarium, europium, gadolinium, terbium, dysprosium, holmium, erbium, thulium, ytterbium and lutetium. Preferably, $Y_2O_3$ is added in a quantity of 130 ppm.

The raw material is admixed with carbonates, oxides and metal particles. A binder preparation may additionally be added to the raw material. Said binder preparation may contain water, ethanol, ethyl nitrate, ethyl acetate or diethyl acetate as the solvent.

The raw material for the cathode coating is subsequently applied to the cathode base by brushing, dip coating, cataphoretic deposition or spraying.

The thickness of the cathode coating preferably ranges from 30 to 80 μm.

The coated oxide cathodes are mounted in the cathode ray tube. The cathodes are formed when the cathode ray tube is being evacuated. For this purpose, the cathodes are heated to a temperature ranging from 1000° C. to 1200° C. At this temperature the alkaline earth carbonates are converted to alkaline earth oxides thereby releasing CO and $CO_2$, after which said alkaline earth oxides form a porous sintered body. After this cathode "burn-off", an activation process is carried out which serves to supply excess elementary alkaline earth metal which is included in the oxides. Said excess alkaline earth metal is formed by reduction of alkaline earth metal oxide. In the actual reduction activation process, the alkaline earth oxide is reduced by the released CO or activator metal. In addition, a current-activation process takes place, which is responsible for generating the required free alkaline earth metal by electrolytic processes at elevated temperatures.

The completely formed electron-emitting material may contain preferably 1 to 5% by weight metal particles.

EXAMPLE 1

As shown in FIG. 1, a cathode for a cathode ray tube in accordance with a first embodiment of the invention comprises a cap-shaped cathode base composed of an alloy of nickel with 0.12 wt. % Mg, 0.06 wt. % Al and 2.0 wt. % W.

The cathode base is situated at the upper end of a cylindrical cathode carrier (bushing) wherein the heater is mounted.

For the covering layer composed of ultrafine metal particles containing nickel, the cathode base is introduced into the ablation chamber of a laser ablation facility. An excimer laser beam is directed at a rotating, cylindrical target of cathode nickel at a pressure of several mbar, which target comprises a suitable quantity of activators, and said excimer laser beam ablates the target. A plasma torch with ablated ultrafine particles forms over the target. By means of a carrier gas flow of $Ar/H_2$, these ablated ultrafine particles are transported to the cathode base where they are deposited. The $Ar/H_2$ carrier gas precludes oxidation of the particles during transport. Other inert gases may also be suitable for this purpose. In accordance with a modification of the method, the laser ablation process starts at low pressures around $10^{-2}$ mbar and a low carrier gas pressure, as a result of which initially a fine-grain compact layer of nickel particles is formed. Subsequently, the gas pressure and the carrier gas flow are increased to bring about deposition of ultrafine particles. This enables the generation of a continuous transition from compact layers to layers comprising ultrafine particles.

The cathode comprises a cathode coating on the upper side of the cathode base. To form the cathode coating, the cathode base is cleaned first. Subsequently, a mixture of 2.0 wt. % metal particles and 98 wt. % powder of a starting compound for the oxide particles is suspended in a solution of ethanol, butylacetate and nitrocellulose with 130 ppm yttrium oxide.

The metal particles are composed of nickel alloy with 0.02% by weight Al, 3.0% by weight W and 6.0% by weight Mo. The grains of the metal particles are needle-shaped with an average needle length of 3±2 μm. The powder with the starting compounds for the oxide particles is composed of barium-strontium-carbonate with 130 ppm yttrium oxide. This suspension is sprayed onto the cathode base.

The layer is formed at a temperature in the range from 650 to 1100° C. in order to bring about alloying and diffusion between the cathode metal of the cathode base and the metal particles.

The cathode thus formed has a direct current carrying capacity of 4 $A/cm^2$, and a service life of 20,000 h at an internal pressure of the tube of $2 * 10^{-9}$ bar.

The invention claimed is:

1. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt.

2. A cathode ray tube as claimed in claim 1, wherein the first cathode metal includes a metal selected from the group consisting of Ni, Co, Ir, Pd, Rh and Pt.

3. A cathode ray tube as claimed in claim 1, wherein the first cathode metal includes an alloy of a metal selected from the group consisting of Ni, Co, Ir, Re, Pd, Rh, Pt and an activator metal selected from the group consisting of Mg, Mn, Fe, Si, W, Mo, Cr, Ti, Hf, Zr, Al.

4. A cathode ray tube as claimed in claim 1, wherein said covering layer further comprises an activator metal selected from the group consisting of Mg, Mn, Fe, Si, W, Mo, Cr, Ti, Hf, Zr, Al.

5. A cathode ray tube as claimed in claim 1, wherein said ultrafine metal particles comprise a slow activator selected from the group consisting of Al, Mo, Ti and Si.

6. A cathode ray tube as claimed in claim 5, wherein the slow activators are added in a quantity ranging from 1 to 4% by weight.

7. A cathode ray tube as claimed in claim 1, wherein the electron-emitting material contains metal particles in a quantity ranging from 1 to 5% by weight.

8. A cathode ray tube as claimed in claim 1, wherein the electron-emitting material contains nickel particles in a quantity of 2.5% by weight.

9. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles comprise an alloy of a second cathode metal selected from the group consisting of Ni, Co, Ir, Re, Pd, Rh, Pt and an activator metal selected from the group consisting of Mg, Mn, Fe, Si, W, Mo, Cr, Ti, Hf, Zr, Al.

10. A cathode ray tube, having at least one oxide cathode comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise en oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein said alkaline earth oxide particles are doped with an oxide selected from the oxides of the group consisting of scandium, yttrium and the lanthanoids cerium, praseodymium, neodymium, samarium, europium, gadolinium, terbium, dysprosium, holmium, erbium, thulium, ytterbium and lutetium.

11. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and, wherein said alkaline earth oxide particles are doped with one of the oxides of yttrium.

12. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein the metal particles in the electron-emitting material are shaped so as to be ellipsoidal or spherical.

13. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein the metal particles in the electron-emitting material are needle-shaped.

14. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein the average particle diameter of the metal particles in the electron-emitting material ranges from 0.2 μm to 5.0 μm.

15. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium. samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein the metal particles are embedded in the particle-particle composite so as to be oriented.

16. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein the metal particles are embedded in the particle-particle composite so as to extend vertically to the surface of the cathode base.

17. A cathode ray tube having at least one oxide cathode, comprising:

a cathode carrier having a cathode base of a first cathode metal, said base further having a covering layer composed of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt, and wherein the metal particles are embedded in the particle-particle composite with a concentration gradient.

18. An oxide cathode, comprising:

a cathode carrier having a cathode base of a first cathode metal, said base further having a covering layer of ultrafine metal particles that contain nickel; and a cathode coating of an electron-emitting material containing a particle-particle composite material of oxide particles and metal particles, wherein said oxide particles comprise an oxide selected from the group consisting of oxides of scandium, yttrium and the lanthanoids cerium, praseodymium, neodymium, samarium, europium, gadolinium, terbium, dysprosium, holmium, erbium, thulium, ytterbium, and lutetium, and an alkaline earth oxide selected from the group consisting of the oxides of calcium, strontium and barium, and wherein said metal particles contain a second cathode metal selected from the group consisting of Ni, Co, Ir, Pd, Rh and Pt.

* * * * *